US009850664B2

(12) United States Patent
Pinheiro et al.

(10) Patent No.: US 9,850,664 B2
(45) Date of Patent: Dec. 26, 2017

(54) HANDRAIL MOUNTING SYSTEM

(71) Applicant: Itasca Plastics Inc, St. Charles, IL (US)

(72) Inventors: Jorge M Pinheiro, Chicago, IL (US); Matthew F Barr, Plainfield, IL (US)

(73) Assignee: Itasca Plastics, Inc., St. Charles, IL (US)

( * ) Notice: Subject to any disclaimer, the term of this patent is extended or adjusted under 35 U.S.C. 154(b) by 201 days.

(21) Appl. No.: 14/052,605

(22) Filed: Oct. 11, 2013

(65) Prior Publication Data

US 2015/0102278 A1 Apr. 16, 2015

(51) Int. Cl.
*E04F 11/18* (2006.01)
*E04F 19/02* (2006.01)

(52) U.S. Cl.
CPC ..... *E04F 11/1802* (2013.01); *E04F 11/1804* (2013.01); *E04F 19/026* (2013.01); *Y10T 29/49947* (2015.01)

(58) Field of Classification Search
CPC ..... E04F 11/1802; E04F 11/1804; E04F 11/1836; E04F 11/1838; E04F 11/18
See application file for complete search history.

(56) References Cited

U.S. PATENT DOCUMENTS 3,023,992 A * 3/1962 Tisdall ..... E04F 11/1804 248/200
3,717,968 A 2/1973 Olsen et al.
4,102,529 A * 7/1978 Neblung ..... E04F 11/181 248/251
5,288,048 A 2/1994 Shreiner
5,529,288 A * 6/1996 Cheng-I ..... E04F 11/1804 256/59
5,544,865 A * 8/1996 Abbaticchio ..... E04F 11/1804 256/65.08
6,508,458 B1 1/2003 Bartlett et al.
6,557,832 B2 5/2003 Shreiner
6,625,950 B1 9/2003 Shreiner et al.
166,525 A1 8/2005 Moulton
6,932,328 B2 * 8/2005 Shreiner ..... E04F 11/1804 248/251
2011/0303811 A1 * 12/2011 Nash ..... E04F 11/1808 248/222.14

FOREIGN PATENT DOCUMENTS

FR 2720382 A1 * 12/1995 ..... B66B 11/0226

* cited by examiner

*Primary Examiner* — Jonathan Masinick
(74) *Attorney, Agent, or Firm* — Erickson Law Group, PC

(57) ABSTRACT

A handrail system includes an elongated rail member; a plurality of attachment elements slidably carried on a back side of the elongated rail member; a plurality of brackets; and a plurality of pins wherein each pin is engageable through a distal end portion of a bracket to fix the attachment element to the bracket. According to the system, the brackets can be pre-mounted at spaced-apart positions onto a wall using fasteners, and then the rail member, with the carried attachment elements, can be mounted to the brackets by slidably adjusting the attachment elements along the rail member to register with the corresponding brackets. A pin is used at each attachment element/bracket pair to fix the attachment elements to the brackets and thus the rail member to the wall.

20 Claims, 5 Drawing Sheets

Fig. 5
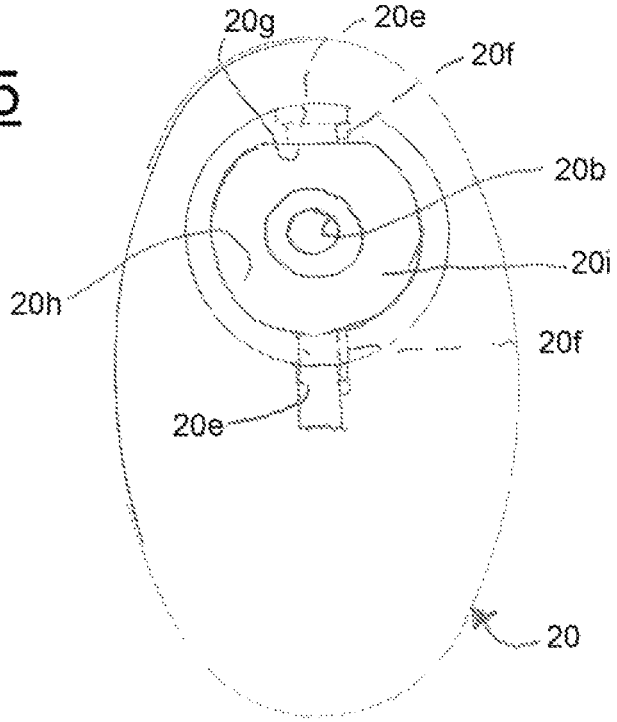
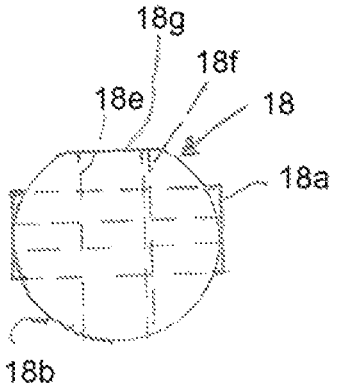
Fig. 6

HANDRAIL MOUNTING SYSTEM

BACKGROUND OF THE INVENTION

In known wall-protecting handrails, rail members are mounted on brackets in a manner such they can deflect and deform under impacts from objects to prevent damage to the underlying wall. The rail members protect the underlying walls and provide support for persons walking through the building. These handrails are widely used in hospitals and nursing homes, where carts, wheelchairs and the like are moved through hallways and are likely to strike the walls.

Known handrails are supported in spaced-apart relation to the walls to allow space between the handrail and the user's fingers. The supports are individual brackets that are strongly attached to the walls and to the handrails. In some cases a single bolt is used that passes through a hole in a portion of the handrail, a corresponding hole in the bracket, and through the wall. Such a system is disclosed in U.S. Pat. No. 5,288,048.

Also known is a handrail installation in which single bolts are used at each support point for the rail and in which the rail need not be drilled to fasten it to the support. The rail and supports permit covers and/or other components to be pre-assembled to the rail before the rail is attached to the supports. All of the supports for the rail can be installed onto the wall or post system (or other supporting structure) before the rail is installed. The rail is then installed onto the supports using a tool. Such a system is disclosed in U.S. Pat. No. 6,508,458.

The present inventors have recognized the need for a handrail assembly that allows the handrail supports to be first installed onto the wall and then the handrail installed onto the supports. The present inventors have recognized the need for supports that eliminate the requirement for using a tool to install the handrail to the supports and that constituted an easily installed and cost effective assembly.

SUMMARY OF THE INVENTION

Embodiments of the invention provide a handrail assembly, and a method of installing the assembly, that reduces the installation time for installing handrails, particularly in an institution like a hospital. The exemplary assembly also reduces parts, the requirement for special tools for installation, and the overall cost of the assembly and installation.

A handrail system includes an elongated rail member, a plurality of attachment elements carried by the elongated rail member on the back side thereof, a plurality of brackets, each attachable at a base end to a wall via an attachment hole in the bracket; and a plurality of pins wherein each pin is engageable through an intermediate portion of a bracket to fix the attachment element to the bracket.

Preferably, the attachment elements are slidably adjustable along the length of the rail member.

Preferably, the distal end of each of said brackets is an open end and partially receives one of said attachment elements within the open end, and one of said pins penetrates through the bracket and the attachment element to fix the attachment element to the bracket.

Preferably, the bracket includes a first through hole and the attachment element includes a second through hole, and when the attachment element is inserted partially into the bracket, the first and second through holes align and the pin is tightly received within both first and second through holes.

Preferably, the attachment element includes a T-shaped retaining element and the rail member includes a T-shaped slot such that the retaining element can slide along a portion of a length of the T-shaped slot without being separated from the rail member.

Preferably, each bracket has a tubular body having the open end and having a portion of an inside perimeter of the open end defined by a flat surface, and the attachment element has a corresponding shape to be snugly inserted into the open end and prevented from rotating therein by the flat surface.

The invention provides a method of attaching a handrail to a wall comprising the steps of:

mounting brackets onto the wall spaced apart horizontally;

providing that a handrail has a connecting slot that slidably receives attachment elements along the slot, the slot configured to prevent separation of the attachment elements from the handrail;

positioning the attaching elements along the slot to register with each of the brackets;

inserting each of the attaching elements into a corresponding bracket;

installing through pins which lock each attaching element to the corresponding bracket.

The invention also provide a bracket system that is applicable to other articles to be mounted, wherein the bracket system includes a bracket mountable to a surface, such as a wall, and an attachment element that is carried by the article to be mounted. The attachment element is attachable to the bracket by use of a pin that penetrates through the bracket and the attachment element. Preferably, the attachment element is slidable along the article, particularly when the article is long and multiple brackets are used for mounting the article to the surface. Preferably, the attachment element is inserted into a tubular open end of the bracket and the pin penetrates through both the attachment element and the bracket to fix the attachment element to the bracket. Preferably, the attachment element includes a T-shaped formation that fits into a T-shaped slot along a back side of the article to be mounted.

Numerous other advantages and features of the present invention will be become readily apparent from the following detailed description of the invention and the embodiments thereof, and from the accompanying drawings.

BRIEF DESCRIPTION OF THE DRAWINGS

FIG. 5 is an end view taken generally along line 5-5 in FIG. 4; and

FIG. 6 is an end view taken generally along line 6-6 in FIG. 4.

DETAILED DESCRIPTION

Figure 1:
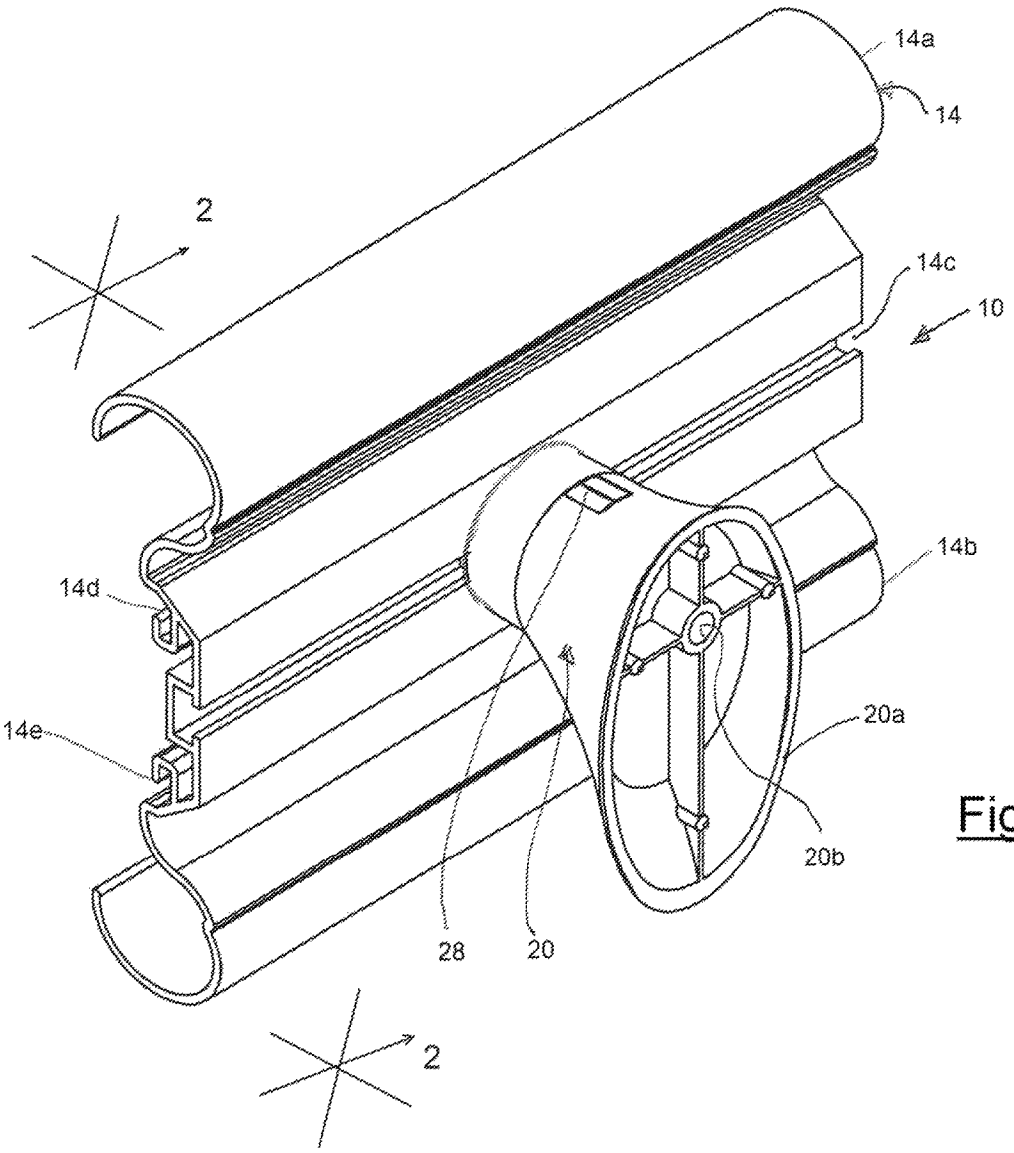
FIG. 1 is a perspective view of a handrail assembly of the present invention in an assembled state with a front cover and bumper removed to see underlying parts.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIGS. 1-6 illustrate an embodiment of a handrail assembly 10. The handrail assembly 10 includes an elongated rail member 14, such as an extrusion, an overlying cover 15 and an impact absorber or bumper 16. The elongated rail member includes upper and lower hand-gripping profiles 14*a*, 14*b*, a prone T-shaped slot 14*c* on a back side and bumper assembly slots 14*d*, 14*e* on a front side. The slots 14*c*, 14*d*, 14*e* are formed in a central body 14*f* between the upper and lower hand-gripping profiles. The assembly 10 also includes a plurality of attachment elements 18 carried by the elongated rail member 14 on the back side thereof, a plurality of standoffs or brackets 20, and a plurality of pins 28. Each bracket is attachable at a base end 20*a* to a wall 24 via a threaded fastener 25 through an attachment hole 20*b* in the bracket 20.

Figure 2:
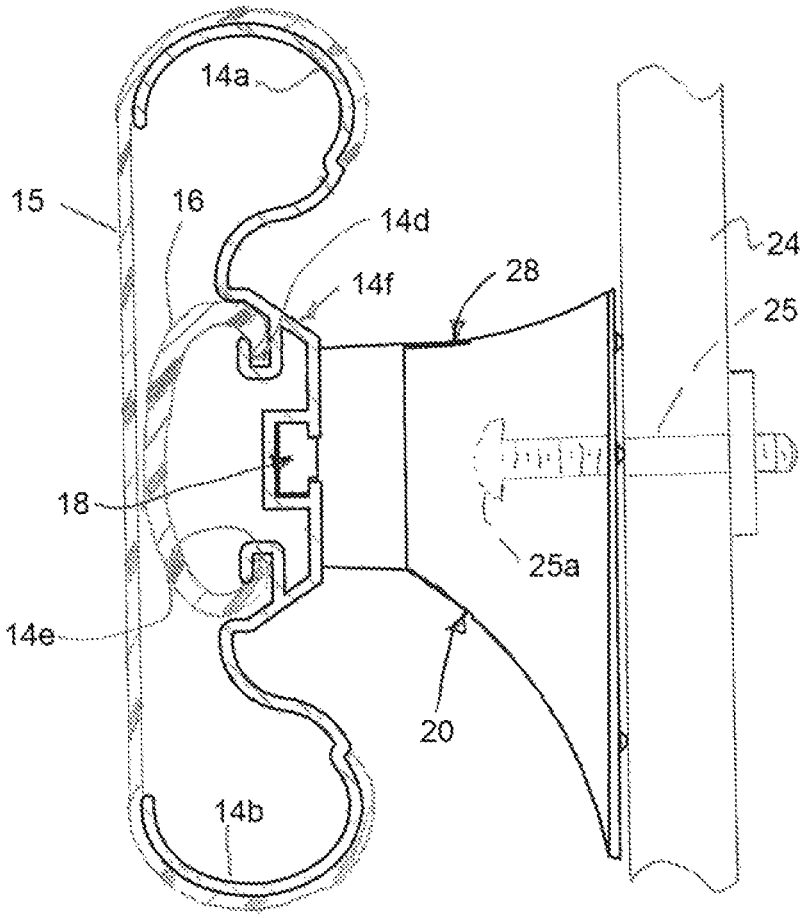
FIG. 2 is a sectional view taken generally along line 2-2 of FIG. 1 with the front cover and bumper installed.

As shown in FIG. 2, the bumper 16 has a generally C-shaped cross-section and edges thereof snap fit into the slots 14*d*, 14*e* to retain the bumper to the rail member 14. The cover 15 has arcuate portions 15*a*, 15*b* that partially surround the hand-gripping formations 14*a*, 14*b* to snap fit the cover 15 onto the rail member 14. The bumper and cover can be installed onto the rail member 14 before the rail member 14 is mounted to the installed brackets 20.

The distal end 20*d* of each of said brackets is an open end and partially receives one of said attachment elements 18 within the open end 20*d*, and one of said pins 28 penetrates through an intermediate portion 20*c* of the bracket 20 and the attachment element 18 to fix the attachment element 18 to the bracket 20.

The bracket 20 includes a first through hole 20*e* and the attachment element 18 includes a second through hole 18*e*, and when the attachment element 18 is inserted sufficiently into the bracket 20, the first and second through holes 20*e*, 18*e* align and the pin 28 is tightly received within both first and second through holes 20*e*, 18*e*.

The pin 28 includes an enlarged head 28*a* and an inclined opposite end 28*b*. The through hole 20*e* is countersunk to accommodate the head flush with the upper contour of the bracket when installed completely. The inclined end 28*b* is shaped to be flush with the lower contour of the bracket when installed completely.

Between the head and the inclined end, on only one side of the pin, is a rib or key 28*c* that tightly fits into a keyway 18*f* in the through hole 18*e* and a keyway 20*f* in the through hole 20*e*. This key and keyway ensures that the pin is properly oriented such that the inclined end terminates flush with the lower contour of the bracket.

The attachment element 18 includes a substantially cylindrical body 18*b* and a prone T-shaped retaining formation 18*a*. The rail member 14 includes the T-shaped slot 14*c* which closely receives the formation 18*a*, slid into the slot 14*c* from an open end of the slot 14*c*. Once installed into the slot, the retaining element 18 can slide longitudinally along the T-shaped slot 14*c* without being separated from the rail member 14.

Preferably, the bracket 20 has a tubular body with the open end 20*d* defining the beginning of a cylindrical void 20*g* which terminates at an end wall 20*i*. The cylindrical void 20*g* is sized to snugly receive the body 18*b* of the element 18. The hole 20*b* is countersunk into the end wall 20*i* to allow for a fastener head 25*a* to be located below the surface of the end wall 20*i* when the bracket is mounted to the wall 24. The void 20*g* has a portion of an inside perimeter defined by a flat surface 20*g*, and the attachment element body 18*b* has a corresponding flat surface 18*g* to be snugly inserted into the void 20*g* and prevented from rotating therein by the flat surfaces 18*g*, 20*g*.

Figure 3:
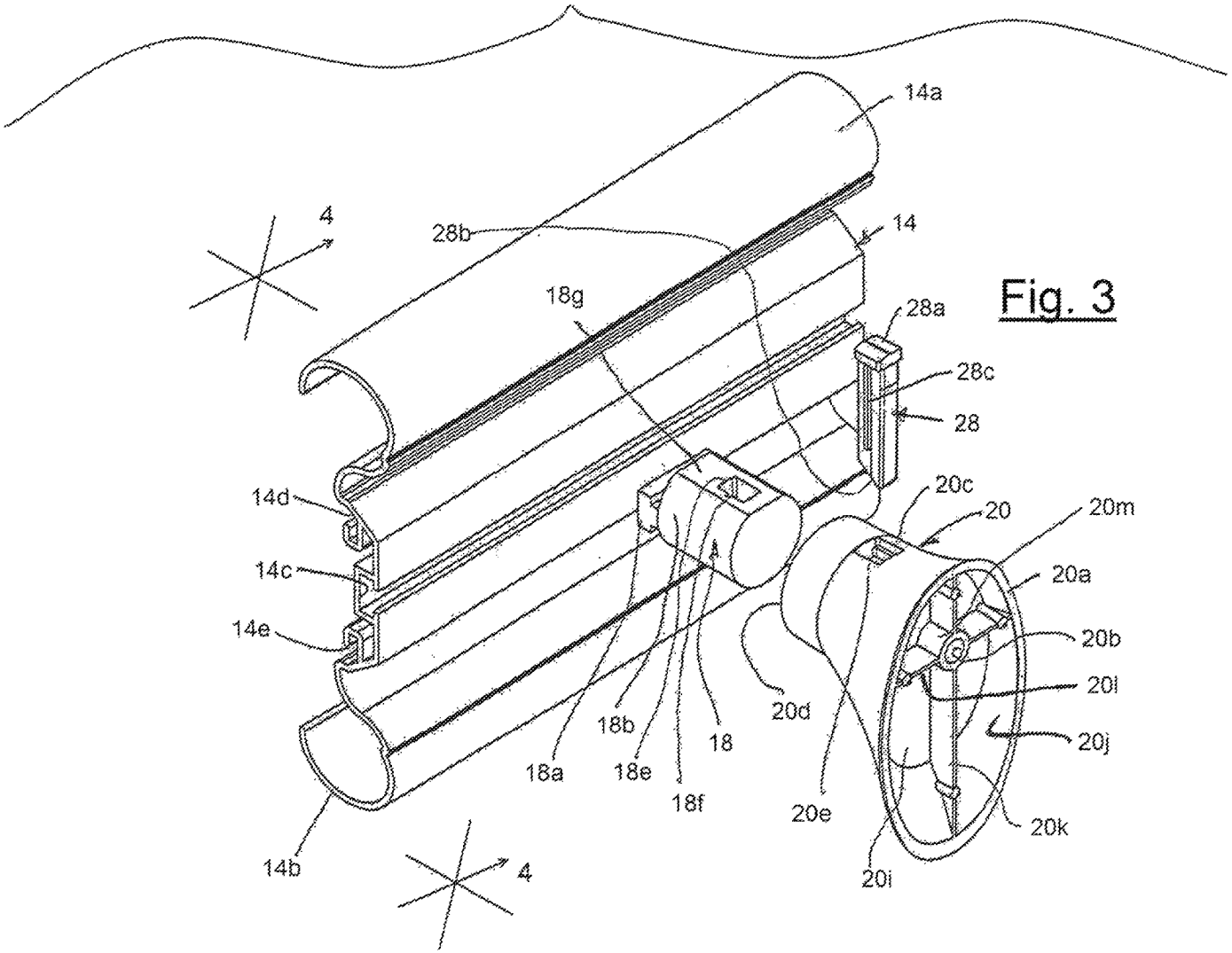
FIG. 3 is a exploded perspective view of the handrail assembly of FIG. 1 in a disassembled state with a front cover and bumper removed to see underlying parts.
Figure 4:
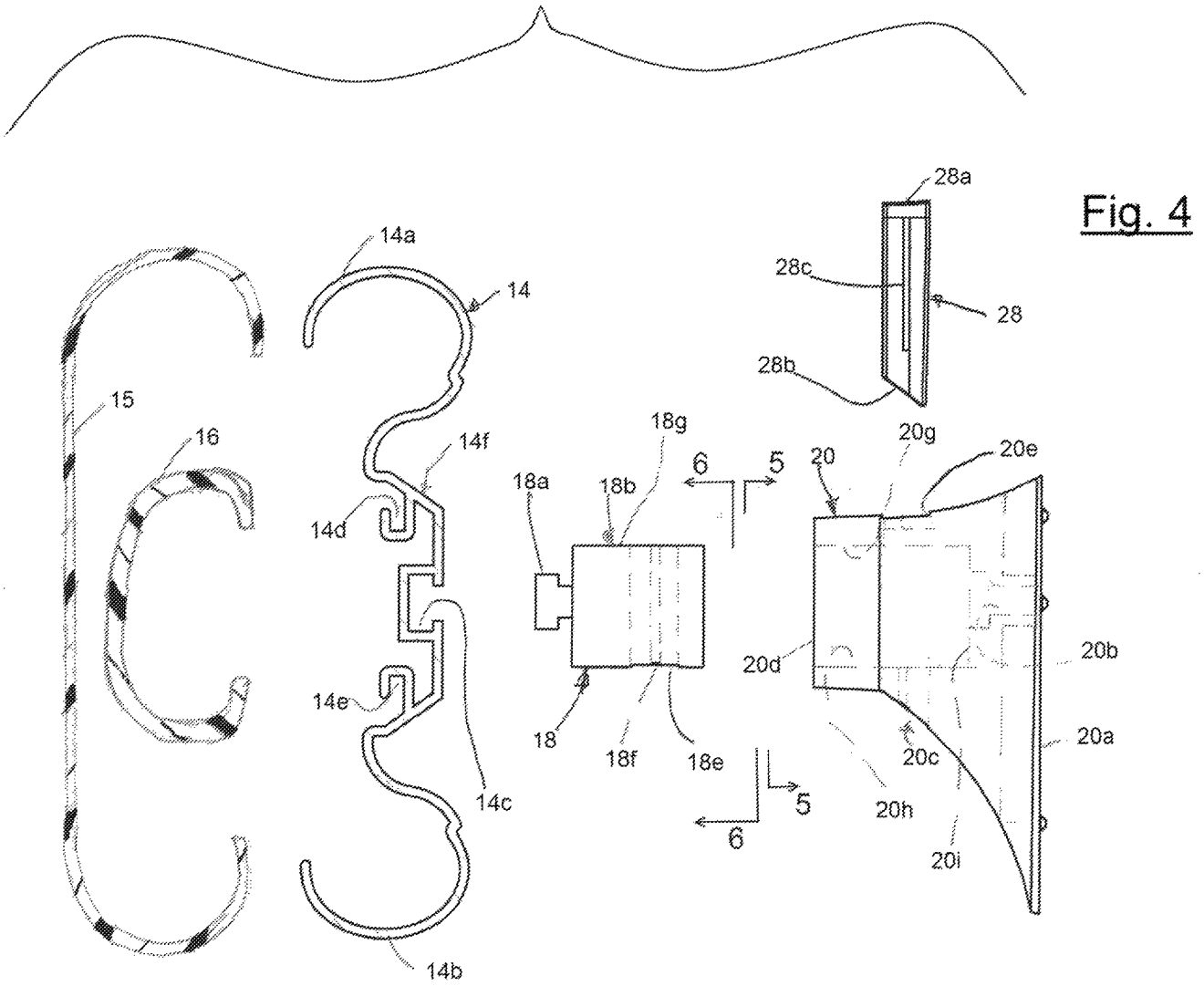
FIG. 4 is a sectional view taken generally along line 4-4 of FIG. 3 with the front cover and bumper included.

As shown in FIG. 3, the bracket 20 has a surrounding base wall 20*j* at the base end 20*a* that terminates at the end wall 20*i*. A vertical rib 20*k* and a horizontal rib 20*l* intersect at a cylindrical boss 20*m* that surrounds the hole 20*b*. The base wall 20*j*, the ribs 20*k*, 20*l* and the boss 20*m* are formed with the end wall 20*i* and the remainder of the bracket 20.

According to exemplary embodiments of the invention, the rail member 14 can be composed of aluminum 6063. The bracket 20 can be composed of copolyester or ABS. The pin 28 can be composed of copolyester or ABS. The retaining element 18 can be composed of ABS. The cover 15 can be composed of copolyester or PVC and the bumper 16 can be composed of copolyester or PVC. Other materials of construction of these parts are also encompassed by the invention.

The invention provides a method of attaching a handrail to a wall comprising the steps of:

mounting brackets 20 onto a wall 24, the brackets 20 spaced apart horizontally;

providing that a rail member 14 has a connecting slot 14*c* that slidably receives attachment elements 18 along the slot 14*c*, the slot 14*c* configured to prevent separation of the attachment elements 18 from the rail member 14;

positioning the attaching elements 18 along the slot 14*c* to register with each of the brackets 20 mounted on the wall;

inserting each of the attaching elements 18 into a corresponding bracket 20;

installing through pins 28 which lock each attaching element 18 to the corresponding bracket 20.

The invention also provide a bracket system that is applicable to other articles to be mounted, wherein the bracket system includes a bracket mountable to a surface, such as a wall, and an attachment element that is carried by the article to be mounted. The attachment element is attachable to the bracket by use of a pin that penetrates through the bracket and the attachment element. Preferably, the attachment element is slidable along the article, particularly when the article is long and multiple brackets are used for mounting the article to the surface. Preferably, the attachment element is inserted into a tubular open end of the bracket and the pin penetrates through both the attachment element and the bracket to fix the attachment element to the bracket. Preferably, the attachment element includes a T-shaped formation that fits into a T-shaped slot along a backside of the article to be mounted.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein, to the extent that the references are not inconsistent with the present disclosure.

The invention claimed is:

1. A handrail system comprising:

an elongated rail member having a front side and a backside, the backside facing a wall onto which the handrail is to be mounted;

a plurality of attachment elements slidably carried by the elongated rail member on the backside thereof;

a plurality of brackets, each bracket attachable at a base end to a wall via an attachment hole in the bracket;

wherein each bracket has a first through hole and each attachment element has a second through hole;

wherein each attachment element, while being slidably held on the elongated rail member, is inserted into a corresponding bracket by a linear movement of the attachment element in a single direction, without relative rotation, toward the corresponding bracket until the first and second through holes are aligned; and a plurality of pins wherein each pin is engageable through the first and second through holes by a linear movement of the pin in a single direction, without relative rotation with respect to the attachment element to fix each attachment element to one of said brackets, wherein said brackets are attachable to the wall independently of the attachment elements and removal of each pin acts to un-fix the attachment element from said one of said brackets with said one of said brackets remaining attached to the wall.

2. The system according to claim 1, wherein the distal end of each of said brackets has an open end and partially receives one of said attachment elements within the open end to a depth corresponding to the first and second through holes being aligned.

3. The system according to claim 2, wherein each pin has a length to pass entirely through the attachment element.

4. The system according to claim 1, wherein each attachment element is slidably mounted on the elongated rail member in a fashion which allows sliding movement only and not rotation with respect to the rail member.

5. The system according to claim 1, wherein said attachment element includes a T-shaped retaining element and the rail member includes a T-shaped slot such that the retaining element can slide along the T-shaped slot without being separated from the rail member.

6. The system according to claim 5, wherein the distal end of each of said brackets has an open end and partially receives the attachment element within the open end to a depth corresponding to the first and second through holes being aligned.

7. The system according to claim 6, wherein each of the brackets has a tubular body having the open end and having a portion of an inside perimeter of the open end defined by a flat surface, and the attachment element has a corresponding shape to be inserted into the open end and prevented from rotating therein by the flat surface.

8. The system according to claim 1, wherein the each of the brackets has a tubular body having an open distal end and having a portion of an inside perimeter of the open distal end with a flat surface, and the attachment element has a corresponding shape to be inserted into the open distal end and prevented from rotating therein by the flat surface, and a corresponding pin penetrates through the bracket and the attachment element to fix the attachment element to the bracket.

9. An attachment bracket assembly for supporting a horizontal handrail, comprising:

a bracket having a base end that is fastenable to a wall;

an attachment element having a base end slidably connected to a back side of a handrail;

wherein the bracket has a first through hole and the attachment element has a second through hole;

wherein the attachment element is inserted into the bracket by movement of the attachment element toward the bracket in a single linear direction, without relative rotation, until the first and second through holes are aligned; and a pin that is sized and shaped to be pushed through the first and second through holes by a linear movement of the pin in a single direction, without relative rotation with respect to the attachment element to lock the bracket to the attachment element, wherein said brackets are attachable to the wall independently of the attachment elements and removal of the pin acts to un-lock the bracket from the attachment element with the bracket remaining fastened to the wall.

10. The attachment bracket assembly according to claim 9, wherein the bracket is substantially tubular having a wider base and tapering to an open distal end, and wherein the attachment element is sized and shaped to be partially inserted into the open distal end of the bracket until the first and second through holes align.

11. The bracket assembly according to claim 10 wherein the pin includes an inclined end surface which, when fully inserted through the bracket and the attachment element, conforms to an outside contour of the bracket.

12. The bracket assembly according to claim 10, wherein the pin comprises a rectangular cross section.

13. The bracket assembly according to claim 12 wherein the base end of the attachment element comprises a T-shaped retainer.

14. The assembly according to claim 9, wherein each pin has a length to pass entirely through the attachment element.

15. A method of attaching a handrail to a wall comprising the steps of:

mounting brackets onto the wall spaced apart horizontally;

providing that a rail member has a connecting slot on a back side of the rail that slidably receives attachment elements along the slot, the slot configured to prevent separation of the attachment elements from the rail member;

positioning the attachment elements along the slot to register with each of the brackets already mounted onto the wall;

inserting each of the attachment elements into a corresponding bracket using a linear movement of the attachment element toward and into the brackets, without relative rotation between the attachment elements and the brackets;

installing pins by a linear movement of each pin in a single direction, without relative rotation with respect to the attachment element, which lock each attachment element to the corresponding bracket.

16. The method according to claim 15, wherein each bracket comprises a substantially tubular body having an open end, and wherein each attachment element is sized and shaped to be partially inserted into the open end of a corresponding bracket, wherein each attachment element and corresponding bracket includes a through hole which are alignable, and wherein the pin penetrates through the aligned through holes to lock the attachment element to the bracket.

17. The method according to claim 16 wherein each attachment element comprises a T-shaped member and the slot comprises a T-shaped slot which slidably captures the T-shaped member.

18. A hand rail assembly, comprising:

a rail member having a longitudinal slot with a T-shaped slot cross section;

a bracket having a base end that is fastenable to a wall, the bracket having an opposite end having an opening into a void;

an attachment element having a base end with a head having a T-shaped cross section that is slidably fit into the longitudinal slot, the attachment element having a body inserted into the void by a linear movement of the attachment element in a single direction, without relative rotation, toward the bracket;

wherein the bracket has a first hole and the body has a second hole, the first and second holes are aligned when the body is inserted into the void and the opposite end of the bracket abuts the rail; and a pin that is sized and shaped to be pushed through the aligned first and second holes by a linear movement of the pin in a single direction, without relative rotation with respect to the attachment element to fix the attachment element to said bracket, wherein said bracket is attachable to the wall independently of the attachment element and removal of said pin acts to un-fix the attachment element from said bracket with said bracket remaining attached to the wall.

19. The rail assembly according to claim 18, wherein the bracket is substantially tubular having the base end being wider than the opposite end, and wherein the void is substantially cylindrical and the body is substantially cylindrical.

20. The rail assembly according to claim 19 wherein the first and second holes are through holes and the pin includes an inclined end surface which, when fully inserted through the bracket and the attachment element, conforms to an outside contour of the bracket.

* * * * *